US012077954B1

(12) United States Patent
Dixon

(10) Patent No.: US 12,077,954 B1
(45) Date of Patent: Sep. 3, 2024

(54) THICKENING AGENT FOR TOILET BOWL WATER

(71) Applicant: Terence Dixon, Capitol Heights, MD (US)

(72) Inventor: Terence Dixon, Capitol Heights, MD (US)

( * ) Notice: Subject to any disclaimer, the term of this patent is extended or adjusted under 35 U.S.C. 154(b) by 176 days.

(21) Appl. No.: 17/979,225

(22) Filed: Nov. 2, 2022

(51) Int. Cl.
*E03D 9/02* (2006.01)
*E03D 9/03* (2006.01)

(52) U.S. Cl.
CPC ..... *E03D 9/022* (2013.01); *E03D 9/032* (2013.01); *E03D 2009/026* (2013.01)

(58) Field of Classification Search
CPC .... E03D 9/022; E03D 9/032; E03D 2009/026
USPC ..... 4/223
See application file for complete search history.

(56) References Cited

U.S. PATENT DOCUMENTS 5,425,806 A 6/1995 Doolan et al.
9,926,695 B2 3/2018 Lehmann et al.
2008/0099041 A1* 5/2008 Evers ..... C11D 17/003 134/3
2013/0092538 A1* 4/2013 Clyde ..... G01N 27/4162 204/431
2014/0059751 A1* 3/2014 Leppla ..... E03D 9/005 4/223
2015/0259896 A1* 9/2015 Jarvis ..... E03F 5/14 210/131
2016/0289941 A1* 10/2016 Hale ..... E03D 9/02
2021/0291235 A1* 9/2021 Everett ..... C11D 1/94

* cited by examiner

*Primary Examiner* — Huyen D Le
(74) *Attorney, Agent, or Firm* — Sanchelima & Associates, P.A.; Christian Sanchelima; Jesus Sanchelima

(57) ABSTRACT

A thickening agent for toilet bowl water including a pellet assembly with a thickening agent assembly and a toilet tank assembly. Pellet assembly contains has a pellet member. The pellet includes a side stamp located below the pellet assembly. The pellet circles the thickening agent assembly. Thickening agent assembly includes a thickening agent. The protruding face of the thickening agent extends from a top surface of the pellet assembly. Toilet tank assembly includes a toilet tank and a toilet bowl. A side stamp is used to stick the pellet member and can be placed inside toilet tank for thickening water with thickening agent assembly when flushing toilet tank.

10 Claims, 4 Drawing Sheets

THICKENING AGENT FOR TOILET BOWL WATER

II. BACKGROUND OF THE INVENTION

1. Field of the Invention

The present invention relates to a thickening agent for toilet bowl water and, more particularly, to a thickening agent for toilet bowl water that pallet apparatus made from a thickening agent for placing in a toilet tank and when flushing toilet, the thickening agent thickens water and avoid splashing when dumping liquid into toilet.

2. Description of the Related Art

Several designs for thickening agents have been designed in the past. None of them, however, include a stamp thickening apparatus for toilet tanks to avoid splashing during urination by thickening water when flushing toilet.

Applicant believes that a related reference corresponds to U.S. Pat. No. 9,926,695 issued for a toilet cleaning apparatus that is positioned below the toilet rim and may contain gel preparation. Applicant believes that another related reference corresponds to U.S. Pat. No. 5,425,806 issued for a water dispersible thickening composition. None of these references, however, teach of a water thickening apparatus for toilet bowls that is comprised of a gelling agent that can be placed in the tank of a toilet and is used to thicken the water in the toilet bowl to reduce the splashing of water during urination.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a pellet to put in the toilet to prevent water and urine from being splashed outside the toilet.

It is another object of this invention to provide a thickening agent for toilet bowl water helps users to keep clean the floor around toilet.

It is still another object of the present invention to provide a thickening agent for toilet bowl water that is biodegradable.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
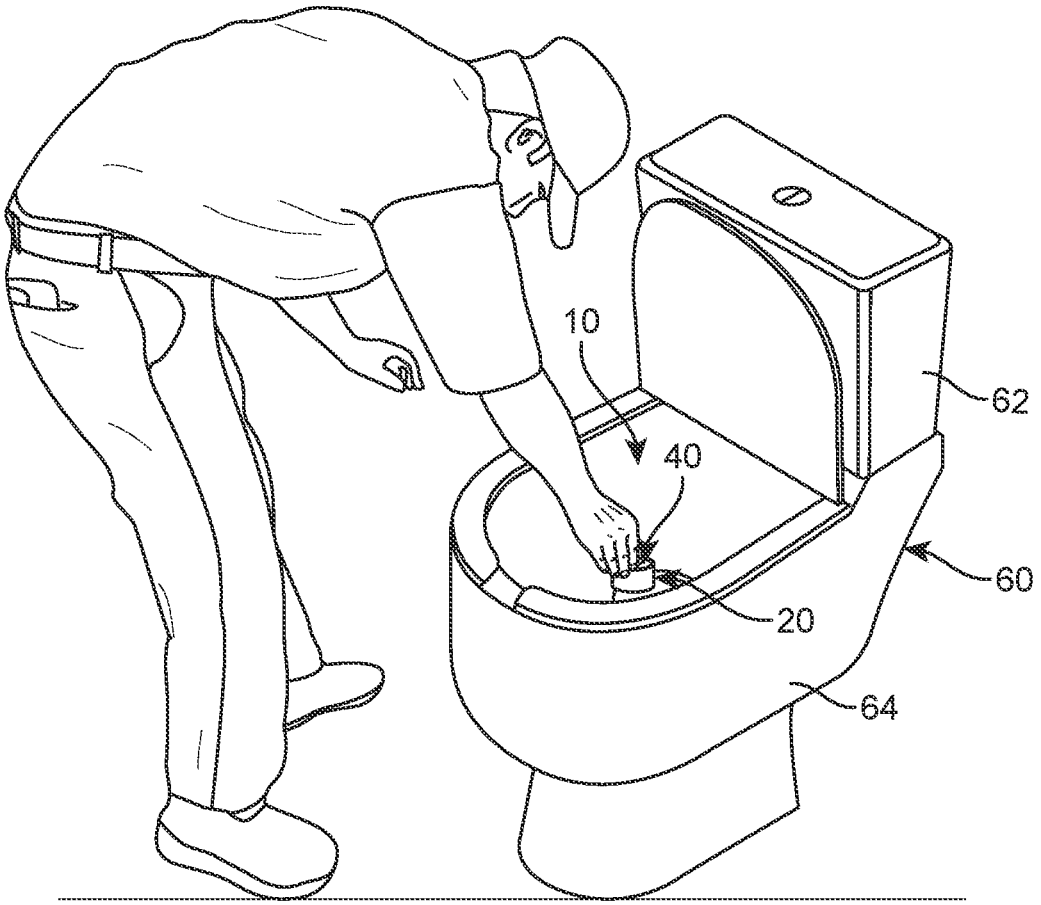

With the above and other related objects in view, the invention consists in the details of construction and combination of parts as will be more fully understood from the following description, when read in conjunction with the accompanying drawings in which:

FIG. 1 represents an isometrical view of the present invention 10 wherein a thickening agent 42 is placed inside a toilet bowl 64.

Figure 2:
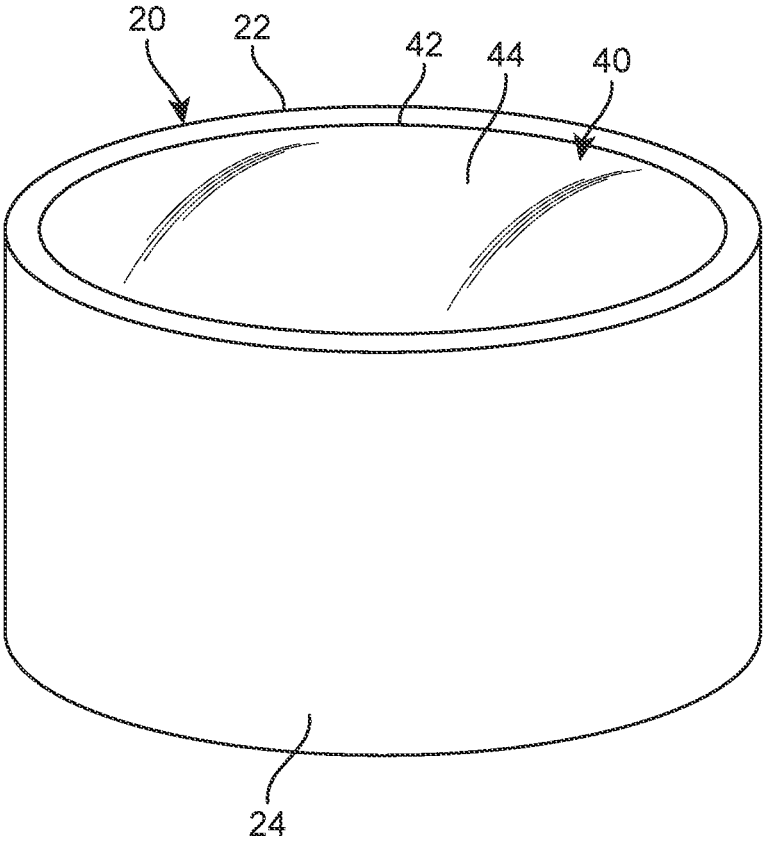

FIG. 2 shows a perspective view of a pellet assembly 20 and a thickening assembly 40.

Figure 3:
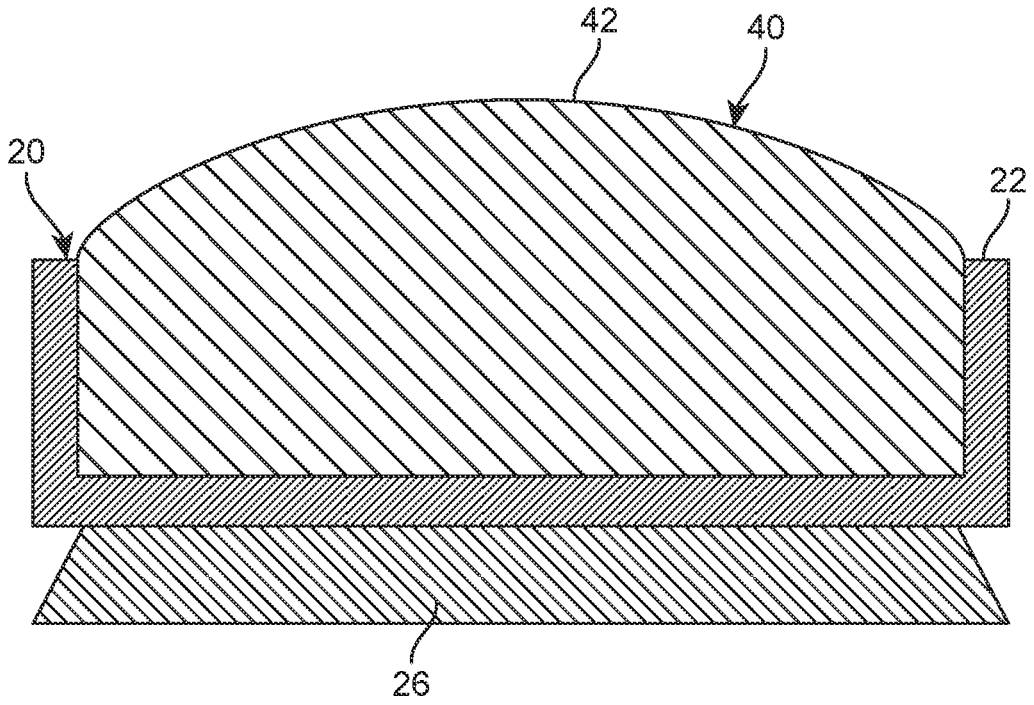

FIG. 3 illustrates a sectional view of the pellet assembly 20 comprising thickening agent assembly 40. Below the pellet assembly 20 is a side stamp 26.

Figure 4:
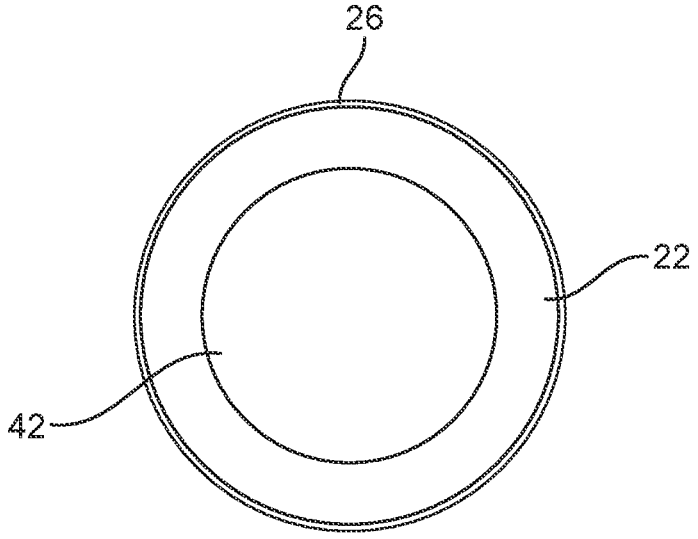

FIG. 4 is a representation of a top view of the pellet 22 with a thickening agent 42 and the side stamp 26.

V. DETAILED DESCRIPTION OF THE EMBODIMENTS OF THE INVENTION

Referring now to the drawings, where the present invention is generally referred to with numeral 10, it can be observed that it basically includes a pellet assembly 20, a thickening agent 40 assembly and a toilet thank assembly 60 . . . It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Pallet assembly 20 includes a pellet member 22, and side face 24 and a side stamp 26. In a suitable embodiment the pellet member 22 may have a cylindrical body. Nevertheless, it should be considered that different bodies like rectangular prism body, triangular prism body, square prism body, hexagon prism body, pentagonal prism body, octagonal prism body or any other variation thereof may be suitable for the pellet member 22. The pellet member 22 may have a hollow body. In one embodiment the pellet member 22 may be made of an organic material like wood ship. Nonetheless, in a different embodiment the pellet member 22 may be made of a bark material, a sawdust material, an agricultural material, a waste wood material. It is to be understood that the pellet member 22 may be located around thickening agent assembly 40 thereby enclosing thereof. In another embodiment pellet member 22 may be located below, on top, on the side of thickening agent assembly 40. In a suitable embodiment the pellet member 22 may be a housing for thickening agent assembly 40. In a suitable embodiment the side face 24 may entirely cover the pellet member 22. Nevertheless, in alternative embodiment, the side face 24 may partially cover the pellet member 22. The side face 24 may be suitable to be made of an organic material like wood ship. Nonetheless, in a different embodiment the side face 24 may be made of a bark material, a sawdust material, an agricultural material, a waste wood material. In a preferred embodiment the side face 24 may have a circular shape as the pellet member 22 may have a cylindrical body. Nevertheless, in different embodiments, the side face 24 may have a square shape, a triangular shape, a rectangular shape, a hexagon shape, a pentagonal shape an octagonal shape or any variation thereof. The side face 24 may be a texture for the pellet member 22. In one embodiment the side stamp 26 may have a rectangular prism body. Nonetheless, it should be considered that any other body like triangular prism body, an octagonal prism body, a hexagonal prism body, a square prism body or any variation thereof may be suitable for the side stamp 26. The side stamp 26 may be made of a polyurethane glue material. Polyurethane glue material has waterproof properties. In a suitable embodiment the side stamp 26 may be located on a bottom surface of the pellet member 22. Nevertheless, in different embodiments, the side stamp 26 may be placed on a top surface, a side surface of the pellet member 22. In a preferred embodiment the side stamp 26 may be configured to attach the pellet member 22 to toilet tank assembly 60.

Thickening agent assembly 40 includes a thickening agent 42 and a protruding top face 44. In a suitable embodiment the thickening agent 42 may be made of a water-soluble material like xanthan gum to thicken water. Nevertheless, in different embodiments the thickening agent 42 may be made of a hydrogel material. As best observed in figure the thickening agent 42 may have a cylindrical body. Nevertheless, in a different embodiment, thickening agent may have a triangular prism body, an octagonal prism body, a hexagonal prism body, a square prism body or any variation thereof. In a suitable embodiment the thickening agent 42 may entirely fill the hollow body of the pellet member 22. Nevertheless, in different embodiments, the thickening agent 42 may partially cover an internal room of the hollow body of the pellet member 22. The thickening agent 42 may be configured to thick water when a user flush toilet tank assembly 60. As best observed in FIG. 3 the protruding face 44 may present a curve shape. Nevertheless, in different embodiments, the protruding face 44 may have a square shape, triangular shape, an uniform shape or any variation thereof. It should be understood that the protruding face 44 may be made of a similar material as the thickening agent 42. In a suitable embodiment the protruding face 44 may extends entirely from a top surface of the pellet member 22. Nevertheless, In a different embodiment the protruding face 22 may extends partially from a top surface of the pellet member 22

Toilet tank assembly 60 includes a toilet tank 62 and a toilet bowl 64. In a suitable embodiment the toilet bowl 64 may be the housing for the pellet member 22 to allow thickening agent 42 to thick water from the toilet tank 62 when flushing thereof and to avoid splash when pouring a liquid thereof. In a different embodiment, the pellet member 22 may be placed in the toilet tank 62.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A thickening agent for toilet bowl water, comprising:

a pellet assembly including a pellet member, said pellet member includes side stamp; and a thickening agent assembly including a thickening agent, said thickening agent includes a protruding top face.

2. The thickening agent for toilet bowl water of claim 1 further including a toilet bowl wherein said pellet member is placed thereof.

3. The thickening agent for toilet bowl water of claim 1, wherein said side stamp is placed on a bottom of said pellet member.

4. The thickening agent for toilet bowl water of claim 1, wherein said pellet member includes a side face to grab by a user.

5. The thickening agent for toilet bowl water of claim 1, wherein said protruding face extends from a top face of said pellet member.

6. The thickening agent for toilet bowl water of claim 1, wherein said thickening agent is placed inside said pellet member.

7. A thickening agent for toilet bowl water, comprising:

a pellet assembly including a pellet member, said pellet member includes side stamp placed to the bottom of said pellet member, said pellet member includes a side face to grab by a user; and a thickening agent assembly including a thickening agent, said thickening agent includes a protruding top face, said protruding face extends from a top face from said thickening agent, said thickening agent is placed inside said pellet member.

8. The thickening agent for toilet bowl water of claim 7, wherein said pellet member is attached inside of said toilet bowl by said side stamp.

9. The thickening agent for toilet bowl water of claim 7, wherein said protruding face of said pellet member provides a thickening of the water due multiple flush of toilet tank.

10. A thickening agent for toilet bowl water, consisting of:

a pellet assembly including a pellet member, said pellet member is made of a hydrogel material, said pellet member includes a side face to grab by a user, said pellet member includes side stamp placed to the bottom of said pellet, said pellet member is attached inside of a toilet bowl by said side stamp; and a thickening agent assembly including a thickening agent, said thickening agent is placed inside said pellet member, said thickening agent includes a protruding top face, said protruding face extends from a top face from said thickening agent, protruding face of pellet member provides a thickening of the water due to flush of toilet tank.

* * * * *